US005162393A

United States Patent [19]

Griffin et al.

[11] Patent Number: 5,162,393

[45] Date of Patent: Nov. 10, 1992

[54] PRODUCTION OF FOUNDRY SAND MOULDS AND CORES

[75] Inventors: John S. Griffin, Coventry, England; Thomas A. Penko, Broadview Heights, Ohio

[73] Assignee: Foseco International Limited, Birmingham, England

[21] Appl. No.: 691,397

[22] Filed: Apr. 25, 1991

[51] Int. Cl.[5] ..... B22C 1/22; C08L 61/10

[52] U.S. Cl. ..... 523/145; 524/594

[58] Field of Search ..... 523/139, 143, 145, 146, 523/147; 524/442, 443, 594

[56] References Cited

U.S. PATENT DOCUMENTS 4,977,209 12/1990 Barker et al. ..... 524/594
4,985,489 1/1991 Barker et al. ..... 524/594

FOREIGN PATENT DOCUMENTS 0066946 5/1980 Japan ..... 523/145
798551 7/1958 United Kingdom .
1592166 7/1981 United Kingdom .

OTHER PUBLICATIONS

Foundry Services Limited Information Sheet 62, "Silicate Bonded Sand", 12 pp.; Jul. 1977.

*Primary Examiner*—Paul R. Michl
*Assistant Examiner*—Peter Szekely
*Attorney, Agent, or Firm*—Nixon & Vanderhye

[57] ABSTRACT

Foundry sand cores are produced by a method comprising the steps of:

(1) providing a core box to contain the core
(2) injecting into the core box a mixture of sand and a binder capable of being cured by means of carbon dioxide gas so as to form the core
(3) passing carbon dioxide gas under pressure into the core box so as to fill the core box
(4) holding the core in contact with the carbon dioxide gas so as to cure the binder
(5) releasing the pressure and allowing carbon dioxide gas to escape from the core box and
(6) removing the cured core from the core box.

The method can also be used to produce moulds and is of particular use in the production of cores or moulds from a mixture of sand and a binder consisting of an alkaline aqueous solution of a phenol-formaldehyde resin and an oxyanion such as borate capable of forming a stable complex with the resin.

21 Claims, 1 Drawing Sheet

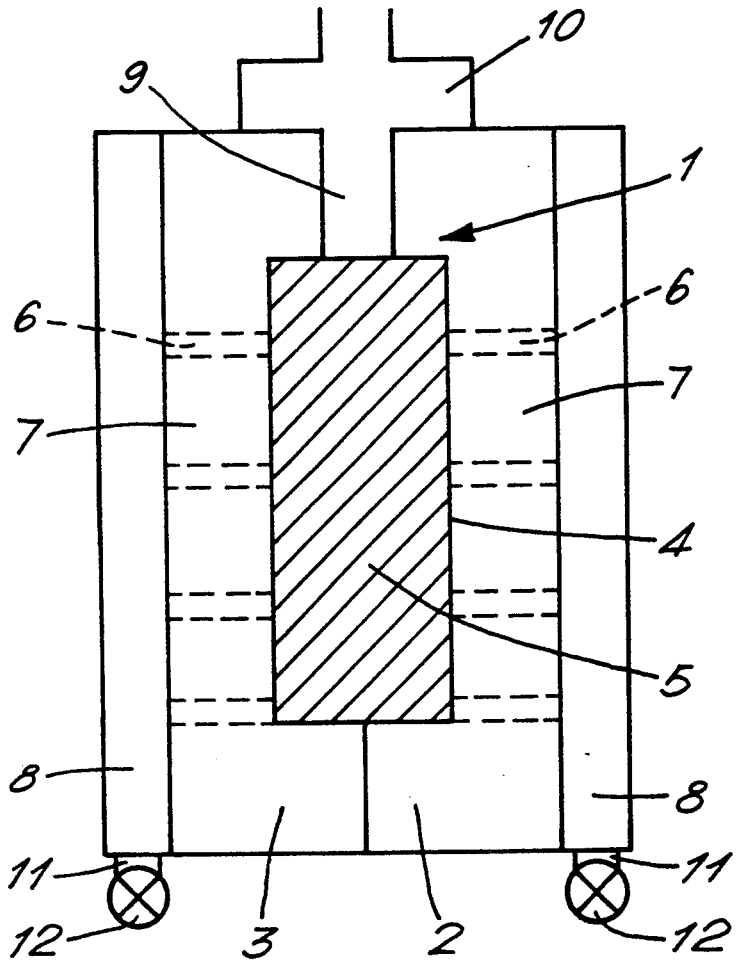
10
9
1
6
6
7
7
4
5
8
8
11
11
12
3
2
12

PRODUCTION OF FOUNDRY SAND MOULDS AND CORES

This invention relates to a method for the production of foundry sand moulds and cores in which the moulds or cores contain a binder which is cured or hardened by passing carbon dioxide gas through the moulds or cores. The method may be used to produce sand moulds but it is particularly useful for the production of sand cores, and it is in that context that the method will be described. As used hereinafter the term "core" also includes a mould.

For many years it has been common practice in foundries to make foundry cores from a mixture of sand and aqueous sodium silicate as binder and to cure or harden the sodium silicate by passing carbon dioxide through the core.

More recently, as described in U.S. Pat. No. 4,977,209 and U.S. Pat. No. 4,985,489 there has been developed a process for making foundry cores in which cores are made from a mixture of sand and a binder comprising an alkaline aqueous solution of a resol phenol-formaldehyde resin and an oxyanion capable of forming a stable complex with the resin. The binder contains sufficient alkali to solubilize the resin and to prevent stable complex formation between the resin and the oxyanion, and sufficient oxyanion to cure the resin when stable complex formation is permitted to take place. Carbon dioxide gas is passed through the cores made from sand and the binder so as to reduce the alkalinity of the binder and to cause the oxyanion to form a stable complex with the resin, and thereby to cure the resin and produce a finished core.

In both the above methods using carbon dioxide gas the normal procedure is to simply pass, the gas straight through the permeable core.

It has now been found that improved results are obtained if the gassing operation is carried out in such a way that the carbon dioxide gas is held within the core for a short period of time instead of being passed straight through the core.

According to the invention there is provided a method of making a foundry sand core comprising the steps of:

(1) providing a core box to contain the core
(2) injecting into the core box a mixture of sand and a binder capable of being cured by means of carbon dioxide gas so as to form the core
(3) passing carbon dioxide gas under pressure into the core box so as to fill the core box
(4) holding the core in contact with the carbon dioxide gas so as to cure the binder
(5) releasing the pressure and allowing carbon dioxide gas to escape from the core box and
(6) removing the cured core from the core box.

The method can be used to produce cores from a mixture of sand and an aqueous sodium silicate binder but it is particularly useful for the production of cores from a mixture of sand and a binder consisting of an alkaline aqueous solution of a resol phenol-formaldehyde resin and an oxyanion, such as borate, capable of forming a stable complex with the resin as described in U.S. Pat. Nos. 4,977,209 and U.S. Pat. No. 4,985,489.

Depending on the method and apparatus used to inject the sand/binder mixture into the core box it may be necessary to compact the mixture after injection, for example by vibration or by ramming prior to gassing.

In carrying out the method of the invention the carbon dioxide gas is preferably passed into the core box at a relatively low input flow rate. In a production foundry practising the method on a relatively large scale the flow rate of carbon dioxide gas will usually be of the order of 3–20 $ft^3$/minute. However when the method is practised on a small scale, for example when producing sand test cores in a laboratory much lower flow rates of the order of 5–15 liters/minute (0.175–0.525 $ft^3$/minute) are used. The carbon dioxide gas will usually be passed into the core box at a pressure of 15–25 psi for 5–15 seconds. Holding of the core in contact with the carbon dioxide gas is preferably done for a short time of approximately 3 times the gassing time at a static pressure of 12–18 psi.

In practice the method of the invention can be readily applied to most conventional core making equipment consisting of a core blower and a core box, and is equally applicable to both vertically parted and horizontally parted core boxes. Exhaust plenum chambers need to be fitted to the exhaust sides of the core box halves, in order to provide a positive seal during the gassing operation. Core making machines of the type used to make cores using binders which are cured by means of sulphur dioxide gas or an amine vapour are particularly suitable as they are usually filled with such plenum chambers. An exhaust pipe or manifold is fitted to each plenum chamber, and means for opening and closing the exhaust pipe such as an electric solenoid valve or an air-actuated valve is attached to each exhaust pipe so that it can be opened to atmosphere during injection of the sand/binder mixture, closed when the carbon dioxide gas is passed into the core box and held in the core box, and opened to relieve carbon dioxide gas pressure and eject the core. At the end of the gassing process the carbon dioxide gas can simply be allowed to exit from the exhaust pipes to the atmosphere.

In the case of a vertically split core box the carbon dioxide gas can be introduced into the core box under relatively low flow rate and pressure at the top or bottom of the box, or at the top and bottom. In the case of a horizontally split core box minor modifications need to be made.

Usually the carbon dioxide is introduced into the core box for approximately 5–12 seconds, and the holding or dwell time of the gas in contact with the core is of the order of 3 times the gassing time.

The method of the invention offers a number of advantages compared with the old method of passing carbon dioxide straight through the core, particularly in the production of cores using the binder described in U.S. Pat. Nos. 4,977,209 and 4,985,489.

The method results in increased "as-gassed" strength of cores, i.e. immediately after removal of the cores from the core box, even at reduced binder additions.

The method also results in uniform curing of the binder throughout the whole core, and enables large or complex cores to be cured at relatively low flow rates of carbon dioxide gas, thus avoiding dehydration of the binder which can occur at high flow rates.

The amount of carbon dioxide consumed in curing the cores can be considerably reduced.

As the binder content can be reduced as a result of using the method the flowability of the sandbinder mixture is improved, and cores can be readily broken and removed from metal castings.

Core production is efficient and rapid and compares favourably with other processes using organic binders which are cured by gas injection.

BRIEF DESCRIPTION OF THE DRAWING

The invention is illustrated with reference to the accompanying drawing which is a schematic representation of apparatus for use in carrying out the method.

DETAILED DESCRIPTION OF THE DRAWING

Referring to the drawing a core box 1 split vertically into two halves 2, 3 has a chamber 4 for containing a core 5. The chamber 4 is connected by a plurality of vents 6 passing through the wall 7 of the core box halves 2, 3 to exhaust plenum 8. The chamber 4 is also connected by a passage 9 to the top of the core box 1 and to gassing head 10 for introducing carbon dioxide gas. Each exhaust plenum has an exhaust pipe 11 fitted with a solenoid valve 12.

In use the two halves 2, 3 of the core box are closed together and the solenoid valves 12 are opened to the atmosphere. A mixture of sand and a binder consisting of an alkaline aqueous solution of a resol phenol-formaldehyde resin and an oxyanion salt, for example a borate, is injected by means of a core blower into the core box 1, for example at 50–60 psi for 1–2 seconds, to form the core 5. The solenoid valves 12 are then closed, and the head of the core blower (not shown) is withdrawn, and the gassing head 10 is placed in position over the passage 9 so as to seal the core box 1. Carbon dioxide gas from a source not shown is then injected into the core 5 through the gassing head 10 at a flow rate of for example 3–20 $ft^3$/minute and a pressure of for example 15–25 psi, so as to fill the chamber 4, the vents 6 and each exhaust plenum 8. The gassing time is short, typically 5–10 seconds, but will vary depending on the size of the core. At this point the "static" box pressure is approximately 12–18 psi. With the solenoid valves 12 still closed and the gassing head 10 still in place, the flow of carbon dioxide gas is then stopped, and the core is held in contact with the carbon dioxide for the desired dwell time, which should be approximately 3 times the gassing time.

Finally the solenoid valves 12 are opened to allow escape of the carbon dioxide gas, the gassing head 10 is removed, the core box 1 is opened and the core is ejected.

During the dwell time slight carbon dioxide gas leakage may occur, for example at the joint between the two halves 2, 3 and at the joint between the gassing head 10 and the top of the core box 1. Such leaks are acceptable providing that a static pressure of the order of 4–8 psi remains in the core box at the end of the dwell time.

The invention is also illustrated by the following example which compares the conventional method for producing $CO_2$ gassed cores with the method of the invention on a laboratory scale.

Standard AFS 2 in diameter ×2 in long cylindrical sand test cores were produced in metal tubes by the standard three ram technique using a mixture of Wedron 510 silica sand and ECOLOTEC 2000, a commercially available alkaline aqueous solution of a resol phenol-formaldehyde resin containing borate ions.

Cores which were to be gassed with carbon dioxide gas by the conventional method of passing gass straight through the core contained 3.0% by weight of the resin binder based on the weight of the sand, and the cores which were to be gassed using the method of the invention contained 2.5% by weight resin binder based on the weight of the sand.

In order to gas the cores one end of the tube was sealed with a cap having an inlet pipe connected to an inlet valve and a source of carbon dioxide gas supply, and the other end was sealed with a cap having an outlet connected to a pressure gauge and an outlet valve.

The cores were gassed either by passing carbon dioxide straight through them with the outlet valve open ("conventional") or by passing carbon dioxide into the core and tube and holding the core in contact with the carbon dioxide gas with the outlet valve closed and then opening the outlet valve to allow carbon dioxide to escape ("invention"). The compression strength of the gassed cores was then measured.

The conditions of the tests and the results obtained are tabulated below:

| GASSING METHOD | CONVENTIONAL | INVENTION |
|---|---|---|
| Core weight (average) | 172 g | 172 g |
| Sand temperature | 70° F. | 70° F. |
| $CO_2$ temperature | 70° F. | 70° F. |
| $CO_2$ input pressure | 15 psi | 15 psi |
| $CO_2$ flow rate | 15 l/minute | 5 l/minute |
| $CO_2$ flow time | 30 sec | 4 sec |
| Dwell time | 0 | 12 sec |
| $CO_2$ consumption (based on weight of sand) | 8% | 0.35% |
| As-gassed compression strength | 260 psi | 350 psi |

We claim:

1. A method of making a foundry sand core comprising the steps:

(1) providing a core box to contain the core (2) injecting into the core box a mixture of sand and a binder capable of being cured by means of carbon dioxide gas so as to form the core (3) passing carbon dioxide gas under pressure into the core box so as to fill the core box (4) holding the core in contact with the carbon dioxide gas so as to cure the binder (5) releasing the pressure and allowing the carbon dioxide gas to escape from the core box and (6) removing the cured core from the core box.

2. A method according to claim 1 wherein the binder consists of an alkaline aqueous solution of a resol phenol formaldehyde resin and an oxyanion capable of forming a stable complex with the resin.

3. A method according to claim 1 wherein the carbon dioxide gas is passed into the core box at a flow rate of 3–20 $ft^3$/minute.

4. A method according to claim 1 wherein the carbon dioxide gas is passed into the core box at a flow rate of 5–15 liters/minute.

5. A method according to claim 1 wherein the carbon dioxide gas is passed into the core box at a pressure of 15–25 psi.

6. A method according to claim 1 wherein the carbon dioxide gas is passed into the core box for 5–15 seconds.

7. A method according to claim 1 wherein step (4) is carried out for a period of time which is approximately 3 times the period of time for step (3).

8. A method according to claim 1 wherein the core box can be parted into two halves and each half has an exhaust plenum on its exhaust side.

9. A method according to claim 8 wherein the core box has a chamber connected by vents to each exhaust plenum.

10. A method according to claim 8 wherein each exhaust plenum has an exhaust pipe fitted with a valve.

11. A method as recited in claim 1 wherein the core box comprises first and second halves, each half having an exhaust plenum on its exhaust side; and wherein step (4) is practiced by preventing carbon dioxide gas from passing through the exhaust plenum, and wherein step (5) is practiced by allowing carbon dioxide gas to pass through the exhaust plenums.

12. A method as recited in claim 11 wherein each exhaust plenum has an exhaust pipe fitted with a valve; and wherein steps (4) and (5) are practiced by controlling the operation of the valves to either allow or prevent the flow of carbon dioxide gas therethrough.

13. A method as recited in claim 12 wherein step (3) is practiced for 4–15 seconds.

14. A method as recited in claim 1 wherein step (3) is practiced for 4–15 seconds.

15. A method as recited in claim 14 wherein step (3) is practiced by passing the carbon dioxide gas into the core box at a pressure 15–25 psi.

16. A method as recited in claim 14 wherein step (3) is practiced by passing the carbon dioxide gas into the core box at a flow rate of 3–20 cubic feet per minute.

17. A method as recited in claim 14 wherein step (3) is practiced by passing the carbon dioxide gas into the core box at a flow rate of 5–15 liters per minute.

18. A method as recited in claim 14 wherein step (4) is carried out for a period of time which is substantially greater than for step (3).

19. A method as recited in claim 18 wherein the period of time step (4) is carried out is approximately three times the time for step (3).

20. A method as recited in claim 19 wherein step (3) is practiced by passing the carbon dioxide gas into the core box at a flow rate of 5–15 liters per minute.

21. A method of making a foundry sand core comprising the steps:

(1) providing a core box to contain the core;

(2) injecting into the core box a mixture of sand and a binder capable of being cured by means of carbon dioxide gas so as to form the core;

(3) passing carbon dioxide gas under pressure under the core box so as to fill the core box;

(4) holding the core in contact with the carbon dioxide gas so as to cure the binder;

(5) releasing the pressure and allowing the carbon dioxide gas to escape from the core box; and (6) removing the cured core from the core box; said steps (1)–(6) being practiced so as to reduce the total carbon dioxide gas treatment time, and carbon dioxide consumption, for a given cured core compressive strength, compared to a method wherein steps (4) and (5) are not practiced.

* * * * *